United States Patent [19]

Tazaki

[11] Patent Number: 4,653,820

[45] Date of Patent: Mar. 31, 1987

[54] LATCH MECHANISM FOR FURNITURE OR THE LIKE

[76] Inventor: Michiharu Tazaki, No. 1301-11, Okazu-cho, Totsuka-ku, Yokohama-shi, Kanagawa-ken, Japan

[21] Appl. No.: 784,586

[22] Filed: Oct. 4, 1985

[30] Foreign Application Priority Data

Oct. 19, 1984 [JP] Japan ..... 59-158690[U]

[51] Int. Cl.[4] ..... A47B 88/04

[52] U.S. Cl. ..... 312/333; 292/226; 292/246

[58] Field of Search ..... 312/320, 333, 215, 222; 292/341.17, 246, 47, 48, 52

[56] References Cited

U.S. PATENT DOCUMENTS

| | | | |
|---|---|---|---|
| 1,302,846 | 5/1919 | Portesi | 292/341.17 X |
| 3,122,402 | 2/1964 | Bullock et al. | 312/333 X |
| 3,218,112 | 11/1965 | Stark | 312/333 |
| 3,239,298 | 3/1966 | McCarthy | 312/333 R |

FOREIGN PATENT DOCUMENTS

| | | | |
|---|---|---|---|
| 768625 | 4/1955 | United Kingdom | 292/341.17 |

*Primary Examiner*—William F. Pate, III
*Assistant Examiner*—Joseph Falk
*Attorney, Agent, or Firm*—Fleit, Jacobson, Cohn & Price

[57] ABSTRACT

A latch mechanism for furniture or the like including a latch actuating unit in which a latch shaft is rotatably supported by a latch mounting plate which in turn is securely attached to one side edge portion of the front plate of a drawer which can be pulled into or out of a steel furniture main body and a latch member whose one end is securely attached to the latch shaft is located between the side wall of said drawer and the side wall of the furniture main body behind the one side edge portion of the front plate of the drawer and is at right angles with respect to an engaging end of the latch shaft; a latch actuating unit in which the rear end portion of a lever plate is attached to an actuating rod supported horizontally by a rod supporting plate securely attached to the front plate of the drawer while the front end portion of the lever plate is located behind the finger engaging portion of a handle securely attached to the front plate of the drawer and in which one end portion of the actuating rod is bent at a right angle to define a kicking end which is at right angles with respect to and engages with the engaging end of the latch actuating unit; and a stopper extended from the inner surface of the side plate of the furniture main body in opposed relationship with an engaging hole of the latch member.

3 Claims, 5 Drawing Figures

LATCH MECHANISM FOR FURNITURE OR THE LIKE

BACKGROUND OF THE INVENTION

The present invention relates to a latch mechanism for furniture or the like and more particularly a latch mechanism adapted to coact with a handle of steel furniture and belongs to International Patent Classification Class A47B88/00.

Drawers of furniture are provided with various types of latch mechanisms, but these latch mechanisms in general are complicated in construction so that not only they are expensive but also they tend to break very often.

SUMMARY OF THE INVENTION

The present invention is made to overcome the above and other problems encountered in the prior art latch mechanisms and has for its object to provide a latch mechanism which is simple in construction yet very robust and easy to operate.

That is, the present invention has an object to simplify the construction of a latch mechanism, thereby improving productivity and consequently reducing the fabrication costs of furniture.

To the above and other ends, the present invention provides a latch mechanism comprising a latch actuating unit in which latch shaft whose one end portion is bent at a right angle in the form of L is vertically and rotatably supported by a latch mounting plate securely attached to one side edge portion of the front plate of a drawer which can be pushed into or pulled out of a steel furniture main body and in which a latch member whose one end is securely attached to the latch shaft is located between the side wall of the drawer and the side wall of the steel furniture main body behind the one side edge portion of the front plate of the drawer and is extended at right angles with respect to the engaging end of the latch shaft and is normally biased in the direction of the side wall of the drawer; a latch actuating unit in which the rear end portion of a lever plate is fitted over an actuating rod which is horizontally supported by a rod receiving plate securely attached to the front plate of the drawer while the front end portion of the lever plate is positioned behind the vertical finger engaging portion of a handle which is securely attached to the front surface of the front plate of the drawer and has an inverted-L-shaped cross section, one end portion of the actuating rod being bent at a right angle relative to the direction in which the lever plate is extended, thereby defining a kicking end which is at right angles with respect to the engaging end of the latch actuating unit and which engages therewith; and a stopper extended from the inner surface of the side wall of the furniture main body in opposed relationship with an engaging hole of the latch member, so that the latch member engages with or disengage from the stopper.

According to the present invention, one portion of the actuating rod is bent like a crank to define a crank portion which is fitted into the rear end portion of the lever plate U-shaped in cross-section.

According to the present invention, the kicking end of the actuating rod of the latch actuating unit is clamped between the guide tabs struck out of the latch mounting plate of the latch actuating unit so that the axial movement of the actuating rod can be prevented.

When the drawer is pushed into the furniture main body, the stopper engages with the engaging hole of the latch member and this engagement can be maintained because the latch member is normally biased in one lateral direction. When one engages one's fingers with the handle in order to withdraw the drawer, the fingers push the front end portion of the lever plate upward so that the lever plate is caused to swing and consequently the actuating rod is rotated.

Upon rotation of the actuating rod, the kicking end of the actuating rod kicks upward the engaging end of the latch shaft so that the latch shaft is rotated.

As a result, the latch member which is attached on the latch shaft is forced in the direction of the side wall of the drawer against a bias spring so that the engaging hole is released from the stopper. Under these condition one can withdrawn the drawer by pulling the handle.

When it is desired to push the drawer into the furniture main body, one pushes the front plate of the drawer and when the drawer is completely pushed into the furniture main body, the latch mechanism is actuated.

That is, when the end of the latch member rides past the stopper, the latch member is pushed by the front surface of the stopper against a bias spring so that the latch member rotates about the latch shaft. When the latch member has ridden over, it returns to its normal position under the force of the bias spring so that the back surface of the stopper engaged with the engaging hole.

The operation of the latch mechanism of the present invention is not intentionally made when the drawer is pushed into or pulled out of the furniture main body. In other words, as in the case of a conventional drawer, when one engages one's fingers with the handle, the drawer is pulled out of the furniture main body and when one pushes the front panel of the drawer, the drawer is pushed into the furniture main body.

The above and other objects, effects, features and advantages of the present invention will become more apparent from the following description of a preferred embodiment thereof taken in conjunction with the accompanying drawings.

DESCRIPTION OF THE PREFERRED EMBODIMENT

Figure 1:
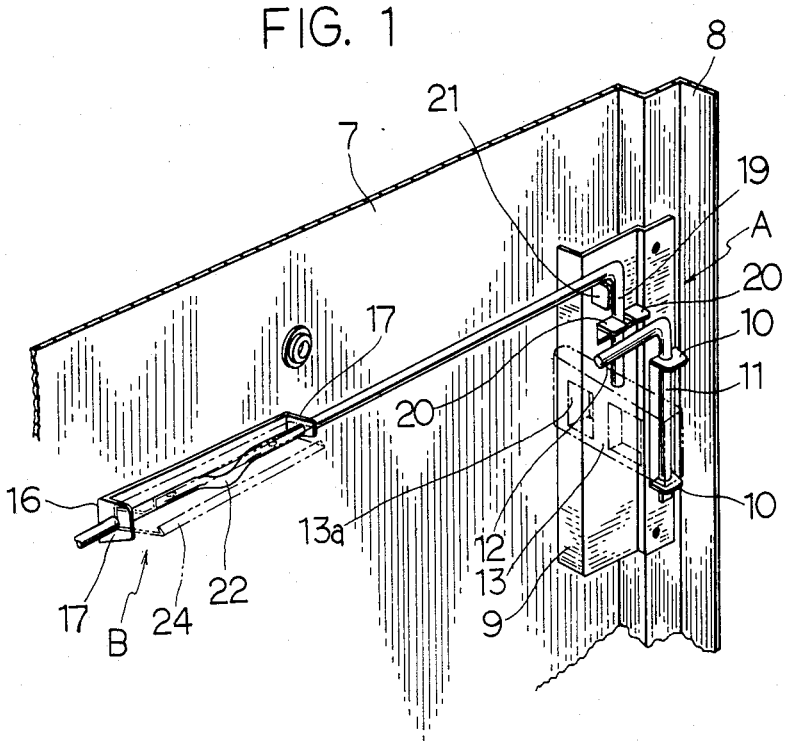
FIG. 1 is a perspective view illustrating the whole construction of a latch mechanism in accordance with the present invention.
Figure 2:
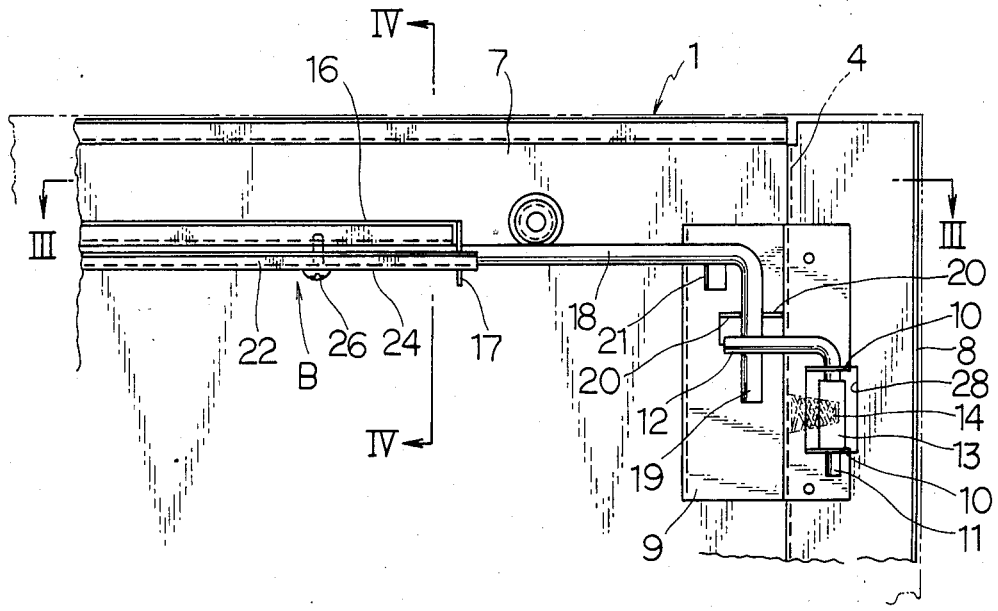
FIG. 2 is a front view thereof.
Figure 3:
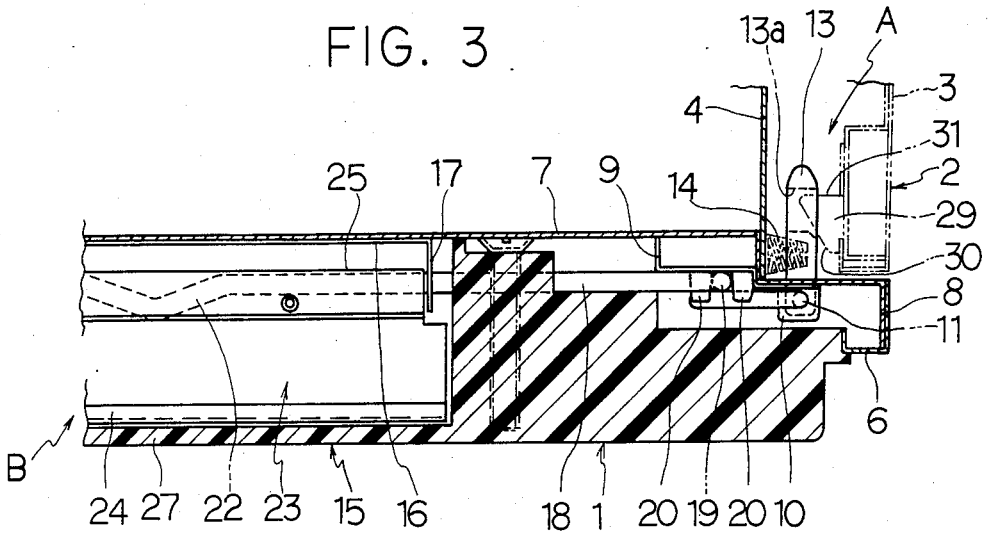
FIG. 3 is a secetional view taken along the line III—III of FIG. 2.

Now a preferred embodiment of a latch mechanism in accordance with the present invention will be described with reference to the accompanying drawings.

A drawer 1 is slidably fitted into a steel furniture main body 2 between the side walls 3 thereof. The side plate 4 of the drawer 1 is spaced apart from the inner surface of the side wall 3 of the main body by a suitable distance and a front plate 6 with a parallel back plate 7 is securely attached to the front edges of the sides plates 4 and a bottom plate 5 in such a way a side edge 8 is defined.

A latch mounting plate 9 is securely attached to the back plate 7 and a latch shaft 11 is rotatably supported by bearing tabs struck out of the latch mounting plate 9.

The upper end portion of the latch shaft 11 is bent through 90° to define an engaging end 12. Thus the latch shaft 11 is in the form of an inverted L. One side edge of a latch member 13 is securely carried by the latch shaft 11 between the upper and lower bearing tabs 10 and the latch member 13 is extended through an opening 28 formed through the back plate 7 at right angles relative to the engaging end 12. The latch member 13 is located between the side wall 3 of the main body 2 and the side wall 4 of the drawer 1 and is normally biased to rotate one direction under the force of a coiled spring 14 loaded between the side wall 4 and the latch member 13. The latch member 13 has an engaging hole 13*a* adjacent to the leading edge portion and constitutes a latch actuating unit A.

Figure 4:
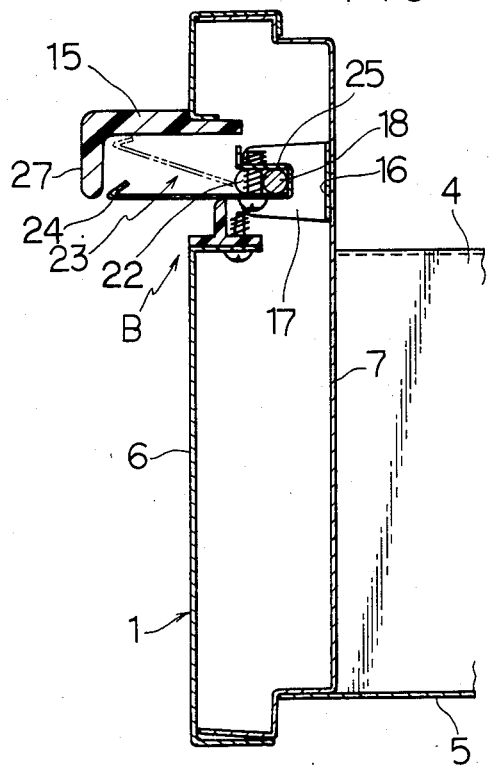
FIG. 4 is a sectional view taken along the line IV—IV of FIG. 2.
Figure 5:
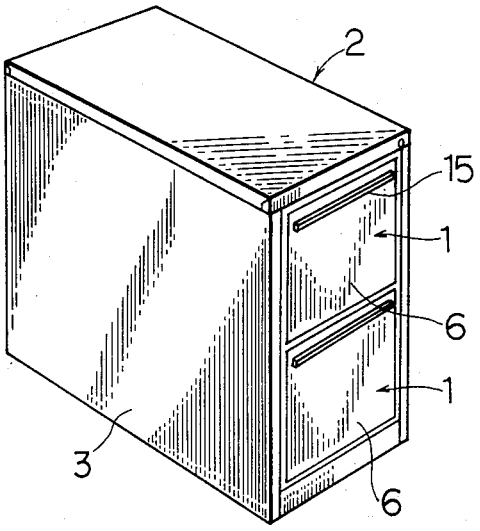
FIG. 5 is a perspective view of a piece of furniture provided with the latch mechanisms in accordance with the present invention.

A handle 15 is attached to the front plate 6 of the drawer and has an inverted L cross sectional configuration and a shaft bearing plate 16 is securely attached to the back plate 7 in opposed relationship with the vertical portion of the handle 15 as best shown in FIG. 4.

An actuating rod 18 is rotatably supported by bearing tabs 17 strucked out of the shaft receiving plate 16 and has its one end extended toward the latch actuating unit A. The leading end portion of the actuating rod 18 is bent through 90° to define a kicking end 19 which is located between the engaging end 12 and the latch mounting plate 9 and perpendicular to the engaging end 12. The kicking end 19 is located between guide tabs 20 struck out of the latch mounting plate 9 and is supported by a rod receiving member 21. The portion of the actuating rod 18 between the bearing tabs 17 is bent like a crank to define a crank portion 22 which is at right angles relative to the kicking end 19. A U-shaped end 25 is inserted through a handle opening 23 formed through the front plate 6 and is fitted over the crank portion 22. The front end of a lever plate 24 which is securely held in position by means of a screw 26 is extended to the vertical portion 27 of the handle 15. Thus the latch actuating unit B is constituted.

A stopper 29 is extended from the inner wall surface of the side plate 3 of the main body 2 in opposed relationship with the engaging hole 13*a* of the latch member 13 and has an inwardly reclined surface 30 and an engaging surface 31 which is at right angles relative to the side plate. The stopper 29 is extended into the path of movement of the latch 13 when the drawer 1 is withdrawn.

When the drawer 1 is pushed into the main body 2, the stopper 29 engages with the engaging hole 13*a* of the latch member 13 so that the drawer 1 is not permitted to be withdrawn out of the main body 2.

When one engages one's fingers with the vertical portion 27 of the handle 15, the fingers push upward the leading end portion of the lever plate 24 (as indicated by the two-dot chain lines in FIG. 4) so that the actuating rod 18 is rotated. Then the kicking end 19 of the actuating rod 18 kicks upward the engaging end 12 of the latch shaft 11 so that the latch shaft 11 is rotated. Simultaneously, the latch member 13 is forced to rotate in the direction of the side plate 4 of the drawer 1 against the coiled spring 14 so that the engaging surface 31 of the stopper 29 is disengaged from the engaging hole 13*a* of the latch member 13.

When the handle 15 is pulled under these conditions, the drawer 1 is withdrawn out of the main body 2.

When one drawer 1 is pushed into the main body 2, the latch member 13 engages with the inclined portion 30 of the stopper 30 so that the latch member 13 is forced in the direction of the side plate 4 against the coiled spring 14 and rides over while rotating. As a result, the engaging surface 31 engages with the engaging hole 13*a*.

As described above, the latch mechanism in accordance with the present invention is very simple in construction and can be engaged or disengaged in response to the operation of pulling the drawer into or out of the main body. Therefore the operation of the latch mechanism is very simple.

So far the present invention has been described with reference to the preferred embodiment thereof, but it is to be understood that various modifications can be effected in order to attain the objects of the present invention without departing the true spirit thereof.

What is claimed is:

1. A latch mechanism for furniture having a main body including a side wall and a drawer, the drawer having a side wall, a front plate and a side edge portion of the front plate, the drawer being pulled out of or pushed into the main body, and a handle securely attached to the front plate of the drawer, said latch mechanism comprising:

a first latch actuating unit including a latch shaft having one end bent in the form of an L to define an engaging end, a latch mounting plate securely attached to the side edge portion of the front plate of the drawer, said latch mounting plate supporting said latch shaft for rotation about a vertical axis, a latch member defining an engagement hole and having a side edge securely attached to said latch shaft and said latch member being located between the side wall of the drawer and the side wall of the main body, behind the side edge portion of the front plate of the drawer and at right angles with respect to said engaging end of said L-shaped latch shaft and being biased to rotate toward the side wall of the drawer;

a second latch actuating unit including a lever plate having a rear end portion and a front end portion, an actuating rod, said rear end portion of the lever plate being fitted over said actuating rod, and a bearing plate attached to the front plate of the drawer and horizontally supporting said actuating rod for rotation about a horizontal axis, said front end portion of said lever plate being located behind a vertical portion of the handle projecting from the front plate of said drawer;

one end portion of said actuating rod being bent at a right angle to define a kicking end located at a right angle relative to a direction in which said lever plate extends, said kicking end being located at right angles relative to and engaging said engaging end of said latch actuating unit for moving said latch shaft upon movement of said lever plate to thereby shift said latch member; and a stopper extended from an inner surface of the side plate of the main body in opposed relationship with said engagement hole of said latch member to hold said latch member in a position of rest and to release said latch member when said latch member is shifted by movement of said latch shaft.

2. A latch mechanism for furniture as set forth in claim 1 wherein a portion of said actuating rod is bent to define a crank portion which engages said rear end portion of said lever plate.

3. A latch mechanism as set forth in claim 1 wherein said kicking end of said actuating rod is clamped between guide tabs defined by a latch mounting plate of said second latch actuating unit so that sliding movement in the axial direction of said actuating rod is prevented.

* * * * *